US011297926B2

(12) United States Patent
Berhault

(10) Patent No.: US 11,297,926 B2
(45) Date of Patent: Apr. 12, 2022

(54) KIT FOR PRODUCING AN ASSEMBLY FOR PACKAGING AND APPLYING A PRODUCT, NOTABLY A COSMETIC PRODUCT

(71) Applicant: L'Oreal, Paris (FR)

(72) Inventor: Alain Berhault, Clichy (FR)

(73) Assignee: L'Oreal, Paris (FR)

( * ) Notice: Subject to any disclaimer, the term of this patent is extended or adjusted under 35 U.S.C. 154(b) by 392 days.

(21) Appl. No.: 16/465,093

(22) PCT Filed: Nov. 27, 2017

(86) PCT No.: PCT/EP2017/080475
§ 371 (c)(1),
(2) Date: May 29, 2019

(87) PCT Pub. No.: WO2018/099845
PCT Pub. Date: Jun. 7, 2018

(65) Prior Publication Data

US 2019/0320779 A1 Oct. 24, 2019

(30) Foreign Application Priority Data

Nov. 29, 2016 (FR) ..... 1661651

(51) Int. Cl.
*A45D 40/26* (2006.01)
*A45D 34/04* (2006.01)

(52) U.S. Cl.
CPC ..... *A45D 40/267* (2013.01); *A45D 34/045* (2013.01); *A45D 34/046* (2013.01);
(Continued)

(58) Field of Classification Search
CPC .. A45D 40/267; A45D 40/264; A45D 40/265; A45D 40/262; A45D 2200/1072;
(Continued)

(56) References Cited

U.S. PATENT DOCUMENTS 4,600,328 A * 7/1986 Clements ..... A45D 40/24 132/218
6,343,887 B1 * 2/2002 Dumler ..... A45D 40/267 401/122

(Continued)

OTHER PUBLICATIONS

International Search Report dated Dec. 12, 2017, issued in corresponding International Application No. PCT/EP2017/080475, filed Nov. 27, 2017, 2 pages.

*Primary Examiner* — David J Walczak
(74) *Attorney, Agent, or Firm* — Christensen O'Connor Johnson Kindness PLLC

(57) ABSTRACT

Kit for producing an assembly for packaging and applying a product, including at least one container delimiting at least one internal volume which contains said product and at least one free edge of which defines an opening for accessing the internal volume, said opening being closed off by a temporary closure member that does not have an applicator member, and at least one device for applying said product that is able to be inserted at least partially into said internal volume and comprises at least one applicator member, a stem and a wiping member mounted around said stem and fixed removably thereto wherein the gripping member forms a cap configured to replace the temporary closure member to form an assembly for packaging and applying the cosmetic product, said gripping member being able to close the opening removably, the applicator member being situated inside the container when the gripping member closes said opening.

15 Claims, 4 Drawing Sheets

(52) U.S. Cl.
CPC ..... *A45D 40/264* (2013.01); *A45D 40/265* (2013.01); *A45D 34/043* (2013.01); *A45D 2200/1072* (2013.01); *A45D 2200/25* (2013.01)

(58) Field of Classification Search
CPC ..... A45D 2200/25; A45D 34/045; A45D 34/043; A45D 34/042; A45D 34/046; A45D 40/24; A45D 2200/05; A45D 40/18
USPC .... 401/121, 122, 126, 130, 16–18; 132/317, 132/314
See application file for complete search history.

(56) References Cited

U.S. PATENT DOCUMENTS

| | | | | |
|---|---|---|---|---|
| 7,033,101 | B2 * | 4/2006 | Han | A46B 11/0006 401/122 |
| 7,287,923 | B1 * | 10/2007 | Chen | A45D 40/24 132/317 |
| 8,087,842 | B2 * | 1/2012 | Bouix | A45D 40/267 401/122 |
| 9,848,694 | B2 * | 12/2017 | Hauger | A45D 40/18 |
| 2009/0320871 | A1 | 12/2009 | Bouix et al. | |
| 2015/0135648 | A1 | 5/2015 | Hauger | |

* cited by examiner

KIT FOR PRODUCING AN ASSEMBLY FOR PACKAGING AND APPLYING A PRODUCT, NOTABLY A COSMETIC PRODUCT

The present invention relates to a kit for producing an assembly for packaging and applying a cosmetic product.

The term "cosmetic product" is understood, in particular within the meaning of the present invention, to mean a product as defined in Regulation (EC) No 1223/2009 of the European Parliament and Council of 30 Nov. 2009 relating to cosmetic products.

More particularly, the packaging and application assembly according to the present invention is intended for the application of a cosmetic product, such as a makeup or care product, for example to keratin fibres, and notably for the application of mascara to the eyelashes or eyebrows.

Mascara is understood to be a composition intended to be applied to the eyelashes or eyebrows. It may notably be a makeup composition for the eyelashes or eyebrows, a makeup base for the eyelashes, known as "base coat", a composition to be applied over mascara, known as "top coat", or a composition for the cosmetic treatment of the eyelashes or eyebrows.

The cosmetic product could also be, for example, a makeup or care product for the lips, for example gloss, or, for example, a makeup or care product for the eyes, for example an eyeliner, or a makeup or care product for the nails, for example a nail varnish.

Numerous cosmetic product applicators that are intended to apply said product notably to keratin fibres, in particular to apply mascara to eyelashes, are known.

Generally, an applicator comprises an applicator member that defines an application surface intended to come into contact with the part of the body to be treated.

The applicator member has a main body or core, of generally elongate shape, which is able to bear application elements that project from said core. Preferably, the application elements extend in a general direction substantially normal to the core.

The applicator also comprises a stem which is secured to a gripping member and at the end of which the applicator member is fixed. The gripping member is generally able to close off, in a sealed manner, the opening of the container containing the cosmetic product.

Different types of applicator member for eyelashes or eyebrows exist, for example applicator members known as "fibre" applicator members and applicator members known as "moulded" applicator members. The "fibre" applicator members are generally formed by helically winding, or twisting, two arms of a metal wire that form a core around tufts of bristles extending radially from the metal wire. The "moulded" applicator members are obtained at least partially by moulding at least one thermoplastic material, in particular an elastomer material.

In addition to the particular composition of the cosmetic product, the applicator plays an important role in the quality of application of the cosmetic product and in the quantity of product deposited. The quantity of product to be deposited is furthermore generally adjusted by a wiping member known as a "wiper" which makes it possible to remove excess product from the applicator before application.

Such cosmetic products, in particular mascaras, are packaged and sold with an associated applicator and an associated wiper in packaging and application devices that comprise, for the one part, a body forming a reservoir which is intended to contain the cosmetic product and a free edge of which delimits an opening, said opening being equipped with a wiping device, and, for the other part, an applicator comprising a stem that has a first end bearing an applicator member and a second, opposite end bearing a gripping member.

The gripping member generally also forms a cap that is able to close the opening of the container in a removable manner, the applicator member being situated inside the reservoir when the gripping member closes the opening of the container.

Thus, the applicator is movable between a position, known as the pick-up position, in which the applicator member is situated inside the reservoir and is able to be brought at least partially into contact with the cosmetic product contained in the reservoir, and a position, known as the application position, in which the applicator member can be brought into contact with a part of the human body to be treated.

The document US 2015/0135648-A1 (GEKA) describes a wiper that also provides a protective function during the transport of the associated cosmetic applicator in order to protect the brush of the latter so that the brush does not get damaged.

For this purpose, the wiper is temporarily mounted on the applicator before being mounted in the container during the final assembly of the applicator and the container to form a packaging an application assembly.

Reference may also be made to the document US 2015/0182003-A1 (Charles P. Neuner), which describes a container, notably for a mascara product, an insert fixed to the neck of the container, and an applicator member for the cosmetic product comprising a gripping member, an applicator stem, and an applicator. The insert is provided to perform several functions. To this end, the insert comprises a portion that forms a wiping member for wiping excess cosmetic product from the applicator, and a threaded portion on which a member for holding the applicator stem is screwed. However, the plurality of parts and the complex shape of the wiping member mean that the various elements have to be joined together at the manufacturing site. This is because, if the various elements were not joined together, the cosmetic product contained in the container could flow out.

As indicated above, the particular association between the cosmetic product, the applicator member and the wiper plays an important role in the application result. This is particularly important for makeup products.

Thus, a user may prefer to use a particular combination of applicator member and cosmetic product formulation, while another user may wish to use the same cosmetic product formulation with a different applicator member or the same applicator member with a different composition.

Unfortunately, it is extremely difficult to provide the user with so many combinations without multiplying the commercial references and increasing the storage and sales space.

Therefore, there is a need to be able to provide more numerous and more personalized cosmetic product/applicator member/wiper combinations.

The subject of the invention is a kit for producing an assembly for packaging and applying a product, notably a cosmetic product, comprising, for the one part, at least one container delimiting at least one internal volume which contains said product and at least one free edge of which defines an opening for accessing the internal volume, said opening being closed off by a temporary closure member that does not have an applicator member.

The production kit comprises, for the other part, at least one device for applying said product that is able to be inserted at least partially into the internal volume of the container and comprises at least one applicator member, a stem bearing said applicator member, a gripping member secured to said stem and a wiping member mounted around said stem and radially fixed removably thereto. The gripping member forms a cap configured to replace the temporary closure member so as to form an assembly for packaging and applying the cosmetic product contained in the container. Said gripping member is thus able to close the opening of said container in a removable manner, and the applicator member is situated inside the internal volume of the container when the gripping member closes said opening.

Thus, the user can themselves personalize the application of a cosmetic product by choosing a container containing the cosmetic product that they wish to apply and the applicator designed for the desired effect. By virtue of this, it is possible to design a wiping member suitable for each cosmetic applicator in order to have effective wiping.

The diameter of the wiper can thus be modified depending on the applicator member in order to optimize the application result.

A "production kit" is understood to be a presentation assembly or a ready-to-assemble assembly comprising at least elements that are sold in a separated form in the same container and are intended to be joined together by the user in order to be used.

The elements, namely the container and/or the applicator, can be packaged separately in dedicated packaging, notably in a blister pack.

A "temporary closure member" is understood to be a closure member that closes off the opening of the container for a limited time, for example during the transport of the container and/or the storage thereof, storage including shop presentation or shelving. While the container is being joined to the application device, the temporary closure member is removed and the gripping member replaces the temporary closure member in order in turn to form a cap that closes off the opening of the container when the application member is located inside the internal cavity of the container. Thus, in this position, the container is closed in a sealed manner, such that the product contained in the internal cavity cannot flow out by virtue of the gripping member forming a cap.

The wiping member is not located in the region of the application device containing the applicator member.

According to one embodiment, the production kit comprises at least two devices for applying said product, the applicator member of the first application device being different from the applicator member of the second application device.

The user thus has several different applicators that each have a wiping member suitable for the applicator member, such that the user can decide which applicator they wish to use depending on the destination of the product to be applied and the quantity of product to be applied.

Advantageously, the outside diameter of the applicator member of the first application device is less than the outside diameter of the applicator member of the second application device.

According to another embodiment, the production kit comprises at least two containers that each contain a cosmetic product, the two cosmetic products having different formulations. Each of the containers delimits at least one internal volume which contains said product and at least one free edge of which defines an opening for accessing the internal volume, each of said openings being closed off temporarily by a temporary closure member that does not have an applicator member.

According to yet another embodiment, the container delimits two internal volumes which each contain a cosmetic product, and at least two free edges of which each define an opening for accessing the internal volume, each of said openings being closed off by a temporary closure member that does not have an applicator member. The two cosmetic products have different formulations.

Thus, it is possible to provide, in a single container, two cosmetic products with different formulations. The user thus has the choice of using one of the applicators and one of the cosmetic products depending on the desired application.

Advantageously, the container comprises at least one neck, at the end of which said opening is situated.

The temporary closure member may be, for example, a membrane seal that is flush with the surface of the free edge so as to temporarily close off said opening, or a lid that is temporarily screwed onto a thread of the opening.

Advantageously, the wiping member comprises a body with an outside diameter substantially equal to the diameter of the opening of the container, the body being delimited by two opposite ends, with one of the ends being in radial contact with the stem.

Said end of the wiping member in radial contact with the stem comprises, for example, a wiping lip that is able to retain said wiping member on the stem by friction on the outer surface of said stem.

Thus, it is not necessary to provide an additional member for fixing the wiping member to the stem of the application device, this making the design and joining together more simple and less expensive.

The wiping lip may delimit, with its free end, a wiping orifice with a cross section smaller than or equal to the cross section of the stem.

According to one embodiment, the gripping member has a tubular mounting skirt comprising a threaded inner surface that is intended to be screwed onto a thread on the free edge of the container after the temporary closure member has been removed. The wiping member can thus be fixed inside said mounting skirt, close to the threaded surface, in order to further increase the security of fixing the wiping member to the application device.

Advantageously, the wiping member comprises a retaining member that is able to cooperate with a complementary retaining member of the container after the temporary closure member has been removed and the application device has been joined to the container.

For example, the applicator member has an outside diameter of between 25 mm and 55 mm, for example equal to 3 mm or 4 mm.

The fixing of the wiping member to the stem is designed to withstand a tractive force for example less than or equal to 1 N.

The applicator member may be produced in the form of a twisted or moulded brush that is intended to apply the cosmetic product to the eyelashes or eyebrows, or it may be produced in the form of an eyeliner, a fine brush, or a foam block intended to apply the cosmetic product to the skin.

Further aims, features and advantages of the invention will become apparent from reading the following description, which is given only by way of non-limiting example and with reference to the appended drawings, in which.

Figure 1:
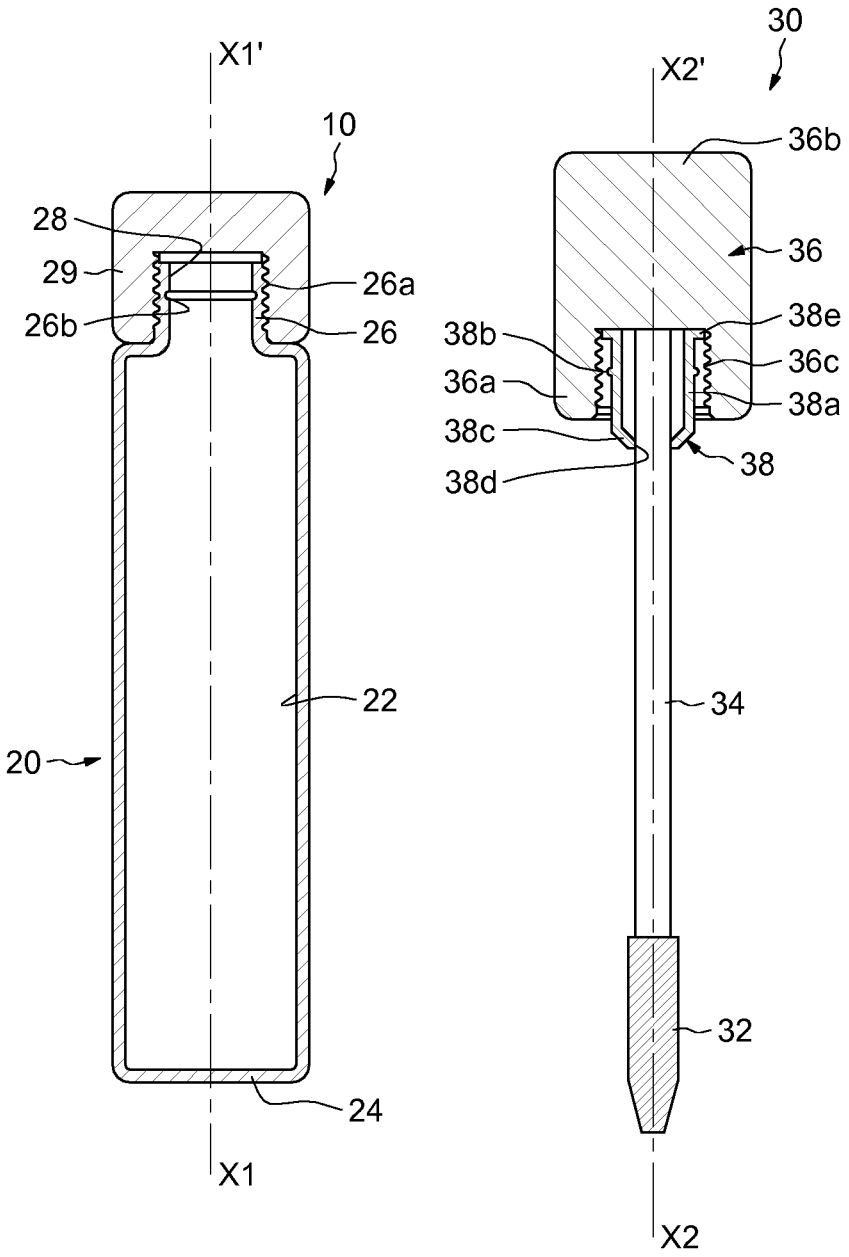
FIG. 1 shows a cross-sectional view of a kit for producing an assembly for packaging and applying a cosmetic product according to a first embodiment of the invention, before it is joined together.

A kit 10 for producing an assembly for packaging and applying a cosmetic product is illustrated in FIG. 1.

The product to be applied may be, for example, a cosmetic product, for example a makeup or care product intended to be applied, for example, to keratin fibres, and notably mascara intended to be applied to the eyelashes or eyebrows of a user. However, the product to be applied could be some other cosmetic or care product, for example a product for making up the lips, for example gloss, or a product for making up the eyes, for example an eyeliner, or a product for making up the nails, for example a nail varnish, or even a non-cosmetic product, for example paint.

As illustrated in FIG. 1, the kit 10 for producing the assembly for packaging and applying a product comprises, for the one part, a container 20 delimiting an internal volume 22 which contains said product, and, for the other part, an application device 30 or applicator for said product.

The container 20 extends along a longitudinal overall axis X1-X1', shown in a position presumed to be vertical.

The body of the container 20 is provided with a closed lower end 24 forming a bottom and an upper end 26 forming a neck provided with an opening 28, opposite the lower end 24, allowing access to the internal volume 22 containing the product. In a variant, provision could be made for the body of the container not to comprise a neck and for the opening to be made in a free edge of said container.

In the embodiment illustrated, the neck 26 has an outside diameter smaller than the outside diameter of the body of the container 20 and comprises, on its outer surface, a thread 26*a*. The body of the container 20 may be made, for example, of rigid plastics material.

As illustrated in FIG. 1, during transport and before the container 20 is joined to the application device 30, the opening 28 of the container 20 is closed off by a temporary closure member 29. The temporary closure member 29 does not have an applicator member for the product contained in the container. In the example illustrated, and in an entirely non-limiting manner, the closure member 29 is a lid that is able to be screwed, in a sealed manner, onto the thread 26*a* of the neck 26. Any other closure member could also be provided, for example a membrane seal that is flush with the surface of the neck in order to close said opening 28.

The application device 30 or applicator extends along a longitudinal overall axis X2-X2', shown in a position presumed to be vertical. The application device 30 comprises an applicator member 32, a stem 34, a gripping member 36 and a wiping member or wiper 38.

The applicator member 32 has a main body or core of elongate shape. The applicator member 32 may be a fibre applicator member or be obtained at least partially by moulding at least one thermoplastic material, in particular an elastomer material. The applicator member 32 may bear application elements (not illustrated in the figures).

By way of indication, the applicator member 32 may have an outside diameter $\phi$ of between 25 mm and 55 mm, for example equal to 3 mm or 4 mm.

The stem 34 comprises a first end fixed to the applicator member 32 and a second end fixed to the gripping member 36. In the example illustrated, the stem 34 has a circular cross section more or less along its entire length. In a variant, other shapes could be provided for the cross section of the stem, for example a polygonal shape, such as a square or rectangular shape, or an oval shape, etc.

The stem 34 and the gripping member 36 may be produced in one piece, for example by injection moulding a plastics material, to which the applicator member 32 is then attached. Provision could be made for the stem to be fixed to the gripping member by any other means, for example by adhesive bonding, screwing, etc.

Figure 2:
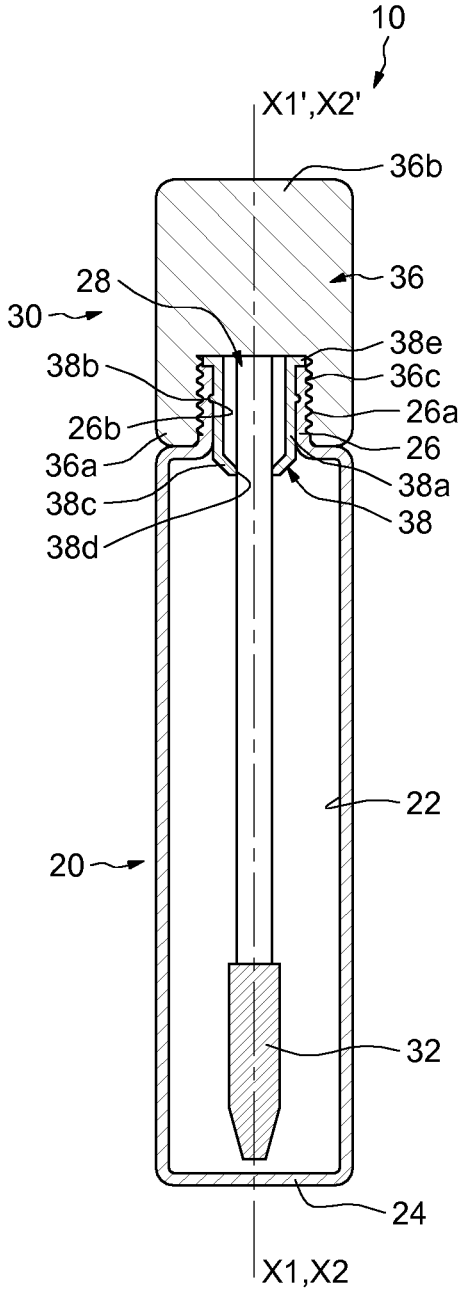
FIG. 2 is a view of the assembly for packaging and applying a product after the kit in FIG. 1 has been joined together.

The gripping member 36 has a tubular mounting skirt 36*a* and a transverse wall 36*b* that extends substantially perpendicularly to the axis X2-X2' and is attached to the mounting skirt. The mounting skirt 36*a* comprises a threaded inner surface 36*c* that is intended to be screwed onto the thread 26*a* on the neck of the container 20 after the closure member 29 has been removed, as can be seen in FIG. 2. The gripping member 36 thus forms a closure cap configured to replace the temporary closure member 29 and thus to close off the opening of the container 20 in a sealed and removable manner. FIG. 2 shows the joined-together position of the kit in FIG. 1 so as to form an assembly for packaging and applying a product, the applicator member 32 being situated inside the internal volume 22 of the container 20 when the gripping member 36 is in the position closing the opening 28 of the container 20.

As illustrated in FIGS. 1 and 2, the wiping member 38 comprises a cylindrical body 38*a* with an outside diameter substantially equal to the inside diameter of the neck 26 of the container. The body 38*a* is delimited by two opposite ends, with one of the ends being in radial contact with the outer surface of the stem 34. The body 38*a* comprises, on its outer surface, a member 38*b* for retaining it on the container 20 after the application device 30 has been joined to the container 20. As illustrated, the retaining member 38*b* is produced in the form of an annular bulge intended to be snap-fastened in a corresponding groove 26*b* made in the inner surface of the neck in the joined-together position, visible in FIG. 2. In this joined-together position, the body 38*a* is mounted radially in sealed contact with the inner surface of the neck 26 of the container. As alternatives, provision could be made for the retaining member to be in the form of a plurality of mutually parallel annular bulges or for the bulge to comprise at least two semi-circular portions that are spaced apart from one another around the circumference of the body of the wiping member.

The wiping member 38 also has, at a first free end of the body, an annular wiping lip 38*c*, defining with its free end a wiping orifice 38*d* with a substantially circular cross section. This wiping lip 38*c* extends in the direction of the stem 34 and is dimensioned so as to press at least against the stem 34, or even also against the applicator member 32 as the applicator is removed from the container. The wiping lip 38*c* in this case extends obliquely with respect to the body 38*a* towards the axis X2-X2'.

The inside diameter of the orifice 38*d* is preferably smaller than or equal to the outside diameter of the stem 34, so as to prevent the product contained in the container 20 from escaping to a space delimited between the stem and the mounting skirt 36*a* of the gripping member 36 of the application device 30 in the joined-together position.

The body 38*a* of the wiping member 38 comprises, at a second end opposite the first end, an annular flange 38*e* having an outside diameter substantially equal to the inside diameter of the mounting skirt 36*a* of the gripping member 36 of the application device 30. After the application device 30 has been joined to the container 20, the flange 38*e* bears axially against the neck 26 of the container.

The wiping member 38 may be made for example of an elastomer material or a polyolefin, notably polyethylene or any other plastics material. The wiping lip 38*c* is, for example, more flexible than the body 38*a* of the wiping member 38.

As illustrated in FIG. 1, before the application device 30 is joined to the container 20, the wiping member 38 is mounted around the stem 34 and radially fixed removably thereto by its first free end. Before the application device 30 is joined to the container 20, the wiping member 38 is not in the region of the application device 30 containing the applicator member 32. Preferably, the wiping member 38 is retained on the stem 34 by friction of the wiping lip 38*c* on the cylindrical outer surface of the stem 34. The removable fixing of the wiping member 38 to the stem 34 is designed to withstand a tractive force less than or equal to 1 N. Under the application of a tractive force for example greater than 1 N on the wiping member 38, the latter is detached from the stem 34.

Preferably, the wiping member 38 is mounted inside the mounting skirt 36*a* of the gripping member 36 such that the annular flange 38*e* is retained axially by the thread 36*c* of the mounting skirt 36. This makes it possible to increase the security of the fixing of the wiping member 38 to the application device 30.

When the user wishes to join together the production kit 10 in order to form an assembly for packaging and applying product, they have to unclose the opening 28 of the container 20 and insert the application device 30 therein. The wiping member 38 is then snap-fastened by its retaining member 38*b* into the corresponding groove 26*b* in the neck of the container. By way of indication, the retaining member 38*b* may be configured to withstand a tractive force less than or equal to 5 N. In the joined together position, visible in FIG. 2, the gripping member 36 bears against the container 20.

Figure 3:
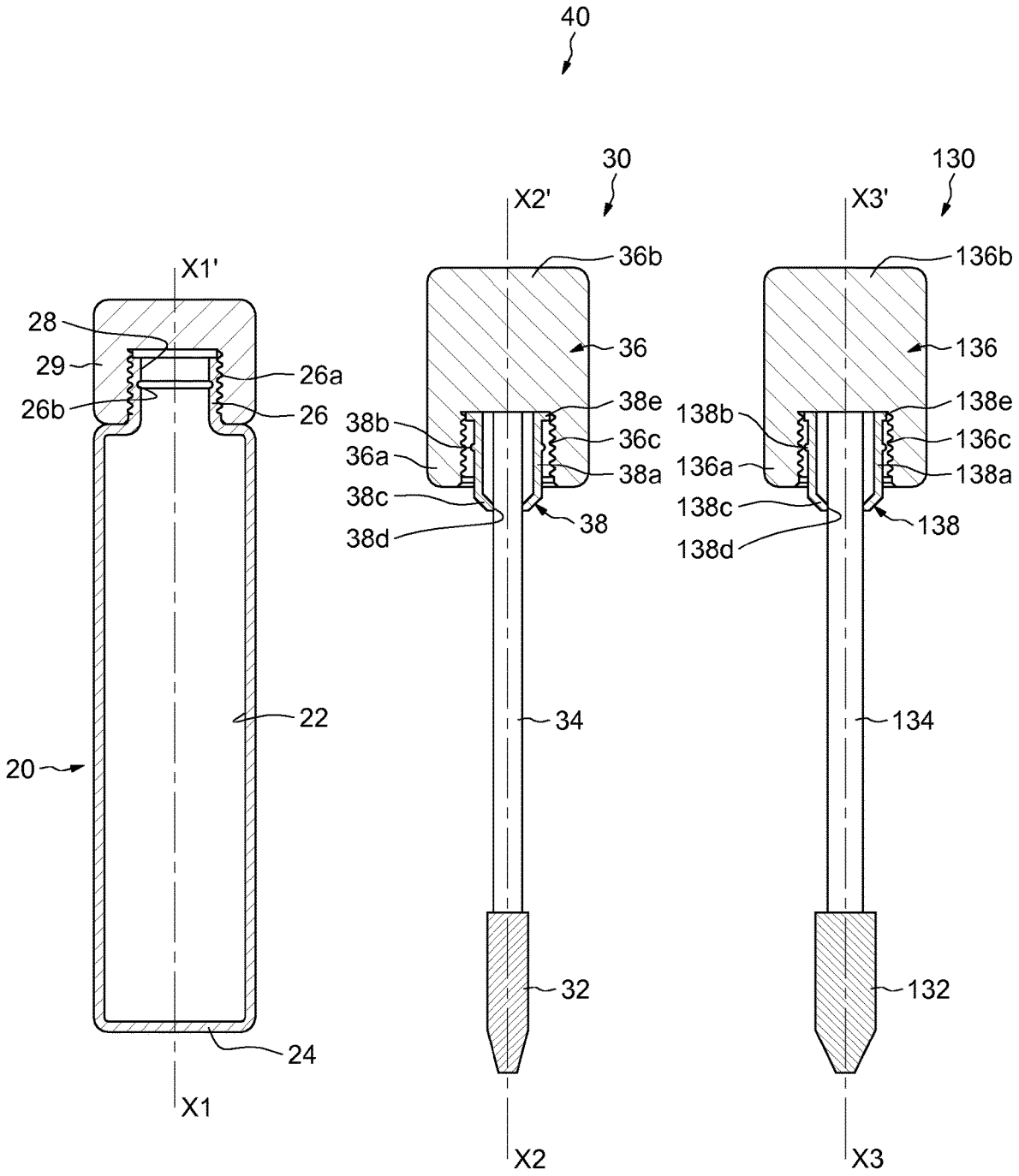
FIG. 3 shows a cross-sectional view of a kit for producing an assembly for packaging and applying a cosmetic product according to a second embodiment of the invention, before it is joined together.

The embodiment illustrated in FIG. 3, in which identical elements bear the same references, differs from the embodiment illustrated in FIG. 1 in that the kit 40 for producing an assembly for packaging and applying product comprises an additional application device 130. The elements of the second application device 130 bearing references incremented by 100 with respect to the references of the elements of the first application device 30 are identical thereto.

In a similar manner to the first application device 30, the second application device 130, or applicator, of longitudinal overall axis X3-X3', comprises an applicator member 132, a stem 134, a gripping member 136 and a wiping member or wiper 138.

As illustrated in FIG. 3, the applicator member 132 of the second applicator 130 has a cross section larger than the cross section of the applicator member 32 of the first application device 30. The applicator member 132 may, for example, have an outside diameter ϕ of between 25 mm and 55 mm. Provision could be made for the applicator member 132 to have an outside diameter smaller than the outside diameter of the applicator member 32. Generally, the applicator member 132 of the second applicator 130 is different, for example by way of its diameter, its shape or its texture, from the applicator member 32 of the first applicator, in order to provide the user with the choice of using one or the other of the two applicators made available to them in the production kit, depending on the desired aim.

Figure 4:
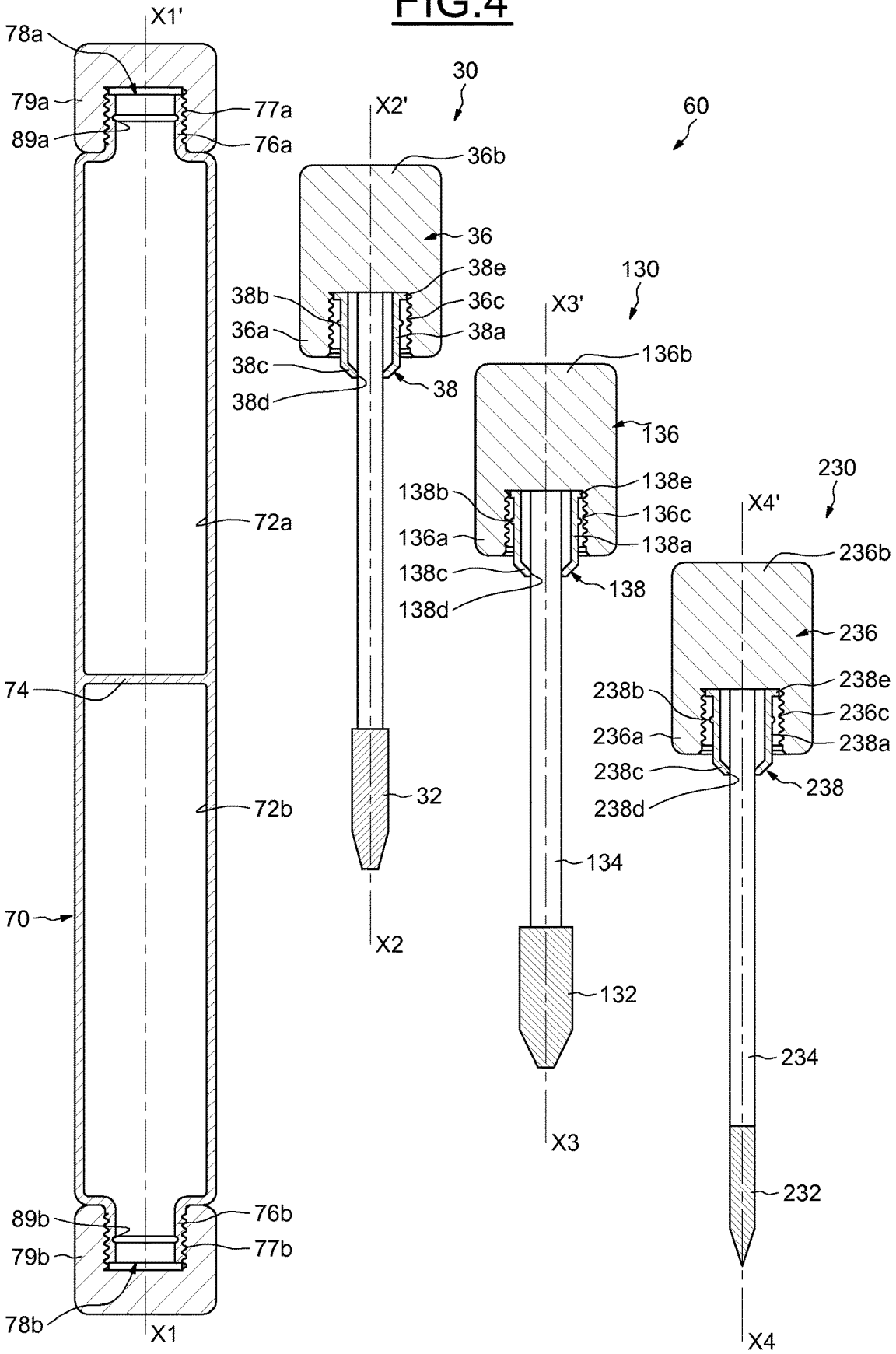
FIG. 4 shows a cross-sectional view of a kit for producing an assembly for packaging and applying a cosmetic product according to a third embodiment of the invention, before it is joined together.

The embodiment illustrated in FIG. 4, in which identical elements bear the same references, differs from the embodiment illustrated in FIG. 3 in that the kit 60 for producing an assembly for packaging and applying product comprises a container 70 delimiting two internal volumes 72*a*, 72*b* which each contain a cosmetic product and three application devices 30, 130 and 230.

The elements of the third application device 230 bearing references incremented by 200 with respect to the references of the elements of the first application device 30 are identical thereto.

The container 70 extends along a longitudinal overall axis X1-X1', shown in a position presumed to be vertical.

The two internal volumes 72*a*, 72*b* are separated by a shared partition 74 that forms the bottom of each of the internal volumes. The body of the container 70 comprises, at each of its ends, a neck 76*a*, 76*b* provided with an opening 78*a*, 78*b* that allows access to the corresponding internal volume 72*a*, 72*b*. Each of the necks 76*a*, 76*b* comprises, on its outer surface, a thread 77*a*, 77*b* and has an outside diameter smaller than the outside diameter of the body of the container 70. The body of the container 70 may be made, for example, of rigid plastics material.

As illustrated in FIG. 4, during transport and before the container 70 is joined to one of the the application devices 30, 130 or 230, the openings 78*a*, 78*b* of the container 70 are closed off by a temporary closure member 79*a*, 79*b*. In the example illustrated, and in an entirely non-limiting manner, the temporary closure member 79*a*, 79*b* is a lid that is able to be screwed, in a sealed manner, onto the thread 77*a*, 77*b* of the corresponding neck 76*a*, 76*b*. Each of the temporary closure members 79*a*, 79*b* does not have an applicator member for the product contained in the container. Any other closure member could also be provided, for example a membrane seal that is flush with the surface of the neck in order to close the opening.

In a similar manner to the first application device 30, the third application device 230, or applicator, of longitudinal overall axis X4-X4', comprises an applicator member 232, a stem 234, a gripping member 236 and a wiping member or wiper 238.

As illustrated in FIG. 4, the applicator member 232 of the third applicator 230 has a cross section smaller than the cross section of the applicator member 32 of the first application device 30. The applicator member 232 may, for example, have an outside diameter ϕ of between 25 mm and 55 mm. Provision could be made for the applicator member 232 to have an outside diameter greater than the outside diameter of the applicator member 32. Generally, the applicator member 232 of the third applicator 230 is different, for example by way of its diameter, its shape or its texture, from the applicator member 32, 132 of the first and of the second applicator 30, 130, in order to provide the user with the choice of using one or another of the three applicators made available to them in the production kit 60, depending on the desired aim.

The third application device 230 is able to be inserted into one of the internal volumes 72*a*, 72*b* of the container 70. After one of the application devices 30, 130, 230 has been inserted into one of said internal volumes of the container for the first time, the retaining member 38*b*, 138*b*, 238*b* of the corresponding application device is snap-fastened into a corresponding groove 89*a*, 89*b* made in the inner surface of one of the necks 76*a*, 76*b* in the joined-together position.

The gripping member 236 of the third application device 230 thus forms a closure cap configured to replace one of the temporary closure members 79*a*, 79*b* and thus to close off one of the openings 78*a*, 78*b* of the container 70 in a sealed and removable manner.

Provision could be made, for example, for the first and second applicators 30, 130 to be applicators for a mascara-type product that is intended to be applied to the eyelashes or eyebrows of the user, and for the third applicator 230 to be an applicator of an eyeliner-type product that is intended to be used to apply the product to the user's eyelid, or for the third applicator 230 to be in the form of a fine brush or of a foam block for the application of a gloss-type product to the user's lips. A kit for producing a packaging and application assembly having a fourth applicator with a different shape from the shape of the third applicator, for applying the same product, could also be provided.

A kit for producing a packaging assembly comprising two similar containers containing different products and a single application device, or comprising at least two similar containers containing different products and at least two different application devices, could also be provided.

By virtue of the packaging and application assembly according to the invention, each applicator comprises a specific wiping member suitable for the application member belonging thereto, such that the quantity of product applied is controlled better, thereby improving the quality of application of the cosmetic product.

Finally, the user may have several different applicators and/or several containers containing different products, and may decide which applicator and which product they wish to use depending on the destination of the product to be applied and the desired quantity of product. The user may thus join together their production kit at home in order to obtain an assembly for packaging and applying product. Thus, the user may themselves personalize the application of cosmetic product by choosing a container containing the cosmetic product that they wish to apply and an applicator designed for the desired effect.

The invention claimed is:

1. Kit for producing an assembly for packaging and applying a product, comprising, at least one container delimiting at least one internal volume for containing said product and at least one free edge of which defines an opening for accessing the internal volume, said opening being closed off by a temporary closure member that does not have an applicator member, and, at least one device for applying said product that is able to be inserted at least partially into the internal volume of the container and comprises at least one applicator member, a stem bearing said applicator member, a gripping member secured to said stem and a wiping member mounted around said stem and fixed removably thereto, wherein the wiping member is not located in a region of the application device containing the applicator member, the gripping member forming a cap configured to replace the temporary closure member so as to form an assembly for packaging and applying the product, said gripping member being able to close the opening of said container in a removable manner, the applicator member being situated inside the container when the gripping member closes said opening.

2. Production kit according to claim 1, comprising at least two devices for applying said product, the applicator member of the first application device being different from the applicator member of the second application device.

3. Production kit according to claim 2, wherein the outside diameter of the applicator member of the first application device is less than the outside diameter of the applicator member of the second application device.

4. Production kit according to claim 1, comprising at least two containers that each contain a product, the two cosmetic products having different formulations, each of the containers delimiting at least one internal volume which contains said product and at least one free edge of which defines an opening for accessing the internal volume, each of said openings being closed off by a temporary closure member that does not have an applicator member.

5. Production kit according to claim 1, wherein the container delimits two internal volumes which each contain a product, and at least two free edges of which each define an opening for accessing the internal volume, each of said openings being closed off by a temporary closure member that does not have an applicator member.

6. Production kit according to claim 1, wherein the container comprises at least one neck, at the end of which said opening—is situated.

7. Production kit according to claim 1, wherein the temporary closure member is a membrane seal that is flush with the surface of the free edge so as to temporarily close off said opening.

8. Production kit according to claim 1, wherein the temporary closure member is a lid that is temporarily screwed onto a thread of the opening.

9. Production kit according to claim 1, wherein the wiping member comprises a body with an outside diameter equal to the diameter of the opening of the container, the body being delimited by two opposite ends, with one of the ends being in radial contact with the stem.

10. Production kit according to claim 9, wherein said end of the wiping member in radial contact with the stem comprises a wiping lip that is able to retain said wiping member on the stem by friction on the outer surface of said stem.

11. Production kit according to claim 10, wherein the wiping lip has a free end and delimits, with its free end, a wiping orifice with a cross section smaller than or equal to a cross section of the stem.

12. Production kit according to any one of the preceding claim 1, wherein the gripping member has a tubular mounting skirt comprising a threaded inner surface that is intended to be screwed onto a thread on the free edge of the container after the temporary closure member has been removed.

13. Production kit according to claim 12, wherein the wiping member is fixed inside said mounting skirt.

14. Production kit according to claim 1, wherein the wiping member comprises a retaining member that is able to cooperate with a complementary retaining member of the container after the temporary closure member has been removed and the application device has been joined to the container.

15. Production kit according to claim 1, wherein the fixing of the wiping member to the stem is designed to withstand a tractive force less than or equal to 1 N.

* * * * *